US007020433B2

(12) United States Patent
Takeuchi et al.

(10) Patent No.: US 7,020,433 B2
(45) Date of Patent: Mar. 28, 2006

(54) TRANSFER MATERIAL CONVEYING APPARATUS AND IMAGE FORMING APPARATUS

(75) Inventors: Akihiko Takeuchi, Shizuoka-ken (JP); Toshiaki Miyashiro, Shizuoka-ken (JP); Atsuyoshi Abe, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/354,024

(22) Filed: Jan. 30, 2003

(65) Prior Publication Data

US 2003/0143005 A1 Jul. 31, 2003

(30) Foreign Application Priority Data

Jan. 31, 2002 (JP) ..... 2002-022960

(51) Int. Cl.
*G03G 15/00* (2006.01)

(52) U.S. Cl. ..... 399/405; 399/322

(58) Field of Classification Search ..... 399/322, 399/340, 341, 400, 405, 401, 406; 492/16–20, 492/53, 56; 271/314, 207, 188, 209
See application file for complete search history.

(56) References Cited

U.S. PATENT DOCUMENTS 3,791,731 A * 2/1974 Mihalik ..... 399/400
4,933,726 A * 6/1990 Moriyama ..... 399/405
5,153,663 A * 10/1992 Bober et al. ..... 399/406
5,655,201 A * 8/1997 Islam et al. ..... 399/322
6,556,806 B1 * 4/2003 Tsuruya et al. ..... 399/322

FOREIGN PATENT DOCUMENTS

JP 63277171 A * 11/1988
JP 01214542 A * 8/1989
JP 01271350 A * 10/1989
JP 04066466 A * 3/1992
JP 04291277 A * 10/1992
JP 09188450 A * 7/1997
JP 2001226015 A * 8/2001

* cited by examiner

*Primary Examiner*—Robert Beatty
(74) *Attorney, Agent, or Firm*—Fitzpatrick, Cella, Harper & Scinto

(57) ABSTRACT

The present invention relates to a transfer material conveying apparatus for conveying a transfer material to which an image is fixed, comprising, an image surface roller located on an imaging surface side of the transfer material and disposed on a downstream side in a conveyance direction of the transfer material of a heating member and a pressing member for fixing an image to the transfer material and a facing roller located in facing to the image surface roller and disposed on a downstream side in a conveyance direction of the transfer material of a heating member and a pressing member for fixing an image to the transfer material. The image surface roller has a length equal to or longer than an image area on the transfer material in a direction perpendicular to the transfer material conveyance direction, and wherein the facing roller is spaced from the image surface roller with a prescribed distance.

16 Claims, 9 Drawing Sheets

TRANSFER MATERIAL CONVEYING APPARATUS AND IMAGE FORMING APPARATUS

BACKGROUND OF THE INVENTION

1. Field of the Invention

This invention relates to a transfer material conveying apparatus for conveying a transfer material to which toner images are heated and fixed and to an image forming apparatus using a heat-fixing method.

2. Description of Related Art

Image forming apparatuses such as electrophotographic apparatuses are becoming faster, multi-colored, and highly functioned these days, and printers of various types are commercially available. From a viewpoint to faster printers, apparatuses using inline types in which images are formed in aligning plural electrophotographic units for forming images in respective colors and in driving those units at the same time, are researched and developed extensively, and those apparatuses possess great potential to be used widely in business because those apparatuses are able to form multicolor images with high speed.

Particularly, inline printers of conveyance belt drive types are frequently developed in which plural electrophotographic unites, in each of which electrophotographic processes such as charge, exposure, development, and cleaning are done in a united body, are aligned linearly for transferring toner images onto transfer materials from the plural electrophotographic units where the transfer materials, or sheets for recording, are attached onto a conveying belt also serving as a transfer belt, because rendered easily compact and inexpensive from a smaller number of process structure elements.

FIG. 5 shows an apparatus structure example of a conventional inline type apparatus. The conventional apparatus has a layout that process stations 20M, 20C, 20Y, 20K in colors of magenta (M), cyan (C), yellow (Y), black (K) placed in a horizontally extending line at a peripheral face of a transfer material conveyance belt (e.g. an electrophotographic transfer belt or ETB) 1 tensioned with a drive roller 2 and a tension roller 3.

A surface of a photosensitive drum 6 in each process stations 20M to 20K is charged uniformly with an electric charger 7, and latent images are formed on the surface with an exposing optical system 8. These latent images are developed by a developing unit 9 to be visualized as toner images. The toner images in respective colors on the respective photosensitive drums 6 are then transferred to a transfer material on a conveyance belt 1 with a transfer roller 4 at a transfer section facing to the photosensitive drum 6, thereby forming a multicolor image by overlaying the four color toner images on the transfer material. Toners remaining after transfers of toner images on the photosensitive drums 6 are wiped out by a cleaner 10 to render the surfaces of the photosensitive drums 6 clean.

The transfer material is fed from a feeding cassette 14, and the transfer material is introduced by a pickup roller 15 to the conveyance belt 1 and is attracted electrostatically to the conveyance belt 1 by application of bias voltage when passing through a nipping section constituted of an attracting roller 5 and a tension roller 3. The transfer material attracted to the conveyance belt 1 is conveyed in a horizontal direction as shown by an arrow by the conveyance belt 1.

The transfer material to which the toner images in four colors are transferred is separated in aid of the curvature at a rear end in the downstream side of the conveyance belt and is conveyed to a fixing unit 11 to be subject to fixing process. The fixing unit 11 includes a heating roller 121 having a halogen heater 121*a*, a fixing section 12 having a pressing roller 122 in pressurized contact with the heating roller 121, and a delivery section 13 made of a pair of delivery rollers 131, 132 formed at the outlet of the fixing section 12.

The four-colored toner images are fixed to the transfer material upon application of heat and pressure when the transfer material is nipped and conveyed to the fixing nipping section constituted of the heating roller 121 and the pressing roller 122. The transfer material to which the toner images are fixed at the fixing section 12 is introduced to the exterior of the fixing unit 11 through the delivery section 13, and is stacked finally on a delivery tray 16.

Furthermore, an inline printer of a vertical conveyance type is recently developed in which the electrophotographic units constituting processing stations are aligned vertically for reducing the installation area size. This printer has a figure that the inline printer of the horizontally conveyance type shown in FIG. 5 is rotated for 90 degrees, and as the transfer material attracted onto the conveyance belt is conveyed upward in opposing to the gravity, the respective process stations transfer the toner images in the respective colors to form full color images on the transfer material and to fix the images with heat by means of the fixing unit mounted at a top of the apparatus.

In addition, an image's transparency when an image is to be outputted on an OHP (Over Head Projector) sheet as a transfer material is needed as a specification required by a color printer to form the image.

Because the OHP sheets are made of a synthetic resin film such as PET (polyethylene-terephthalate) having a thickness about 100 microns and have a larger heat capacity than ordinary transfer materials such as plain paper, a heat supply is much more substantial than an ordinary heat supply is required for fixing process. It is necessary to melt surely the toner images on the OHP sheet and to render the surface of the toner images smooth to order to obtain good transparency. When the transferred toner images are fixed on the OHP sheet, the heat amount applied per unit time is increased by raising the fixing temperature or reducing the conveyance speed for fixing process.

In a case of inline printers of the horizontal conveyance type in which the electrophotographic units are aligned horizontally, the fixing unit is disposed beside the conveyance belt, and the positional relation between the heating roller and the pressing roller in the fixing unit is of a layout that the heating roller exists over above the pressing roller. As shown in FIG. 6, when the OHP sheet S is passed to the fixing nipping section, the OHP sheet S softened due to heat is delivered to the exterior of the apparatus by the delivery roller pair 131, 132 in forming a route extending downward as shown with solid line Ts where the OHP sheet S takes the delivery direction directing downward, or namely closely to the pressing roller 122 by the self-weight.

On the other hand, in a case of inline printers of the vertical conveyance type in which the electrophotographic units are aligned vertically, operation is done as shown in FIG. 7. With this structure, the fixing unit 11 is located over the conveyance belt, and the positional relation inside the fixing unit 11 is of a layout that the delivery section 13 is located right above the fixing unit 12, thereby rendering the OHP sheet S substantially vertical at the fixing nipping section. As different from the structure of the horizontal conveyance type, the OHP sheet S does not have the effect directing the delivery direction closely to the pressing roller 122 by the self-weight and does not take a stable route while taking a route T0 in FIG. 7 as well as taking routes T1, T2 curving toward the sides of the heating roller 121 and the pressing roller 122, respectively.

Accordingly, with the apparatus structure as shown in FIG. 8, it is necessary to design the length between the fixing nipping section and the delivery roller pair 131, 132 to be shorter or to provide some guide in order to render the sheet conveyance route always. e.g., the route T2.

When the OHP sheet S passes through the delivery roller pair 131, 132 as shown in FIG. 8, however, the OHP sheet P is subject to very high temperature, and therefore, when the delivery roller 131 divisionally arranged in a longitudinal direction, or namely the perpendicular direction to the sheet conveyance direction, comes in contact with the side on which the toner images are formed, the toner image surface at a high temperature is partly pushed down by the delivery roller 131, thereby raising problems to generate unevenness in smoothness, to produce stripe-shaped unevenness (or roller mark) when the OHP sheet S is subject to projection, and to render the projection image quality of the color images very inferior. This is a problem more easily occurring as the fixing nipping section is located more adjacently to the delivery roller pair 131, 132. Such a problem occurs frequently even in the structure as shown in FIG. 6, and occurs very frequently in the structure shown in FIG. 7 where the delivery roller pair 131, 132 is placed closely to the fixing nipping section.

To prevent this problem from occurring, a possible solution is to make the delivery roller pair wider, or namely having a width comparable to the sheet width, in the longitudinal direction as a pair of delivery rollers 133, 134 as shown in FIG. 9, but such a situation raises a new problem that the OHP sheet S is abruptly cooled with the delivery roller pair 133, 134 to generate curling.

It is an object of the invention to prevent scars such as roller marks or the like at images on the sheet from occurring as well as to prevent curls of the sheets from occurring.

SUMMARY OF THE INVENTION

A representative structure of the invention to accomplish the above object is a transfer material conveying apparatus for conveying a transfer material to which an image is fixed, including an image surface roller located on an imaging surface side of the transfer material, a facing roller in facing to the image surface roller, wherein the image surface roller has a length equal to or longer than an image area on the transfer material in a direction perpendicular to the transfer material conveyance direction, and wherein the facing roller is spaced from the image surface roller with a prescribed distance.

According to the above structure, the images on the transfer material do not suffer from any scar such as a roller mark or the like, and the transfer material will not be subject to curling.

DESCRIPTION OF PREFERRED EMBODIMENTS

Hereinafter, with reference to the drawings, preferred embodiments of the invention are exemplified in detail. It is to be noted that such as size, material, shape, and correlative layout of structural parts described below in the embodiments can be altered properly according to the apparatus structure and various conditions to which this invention applies, and the scope of the invention should not be limited to those as far as limitation is not specially stated.

First Embodiment

Figure 1:
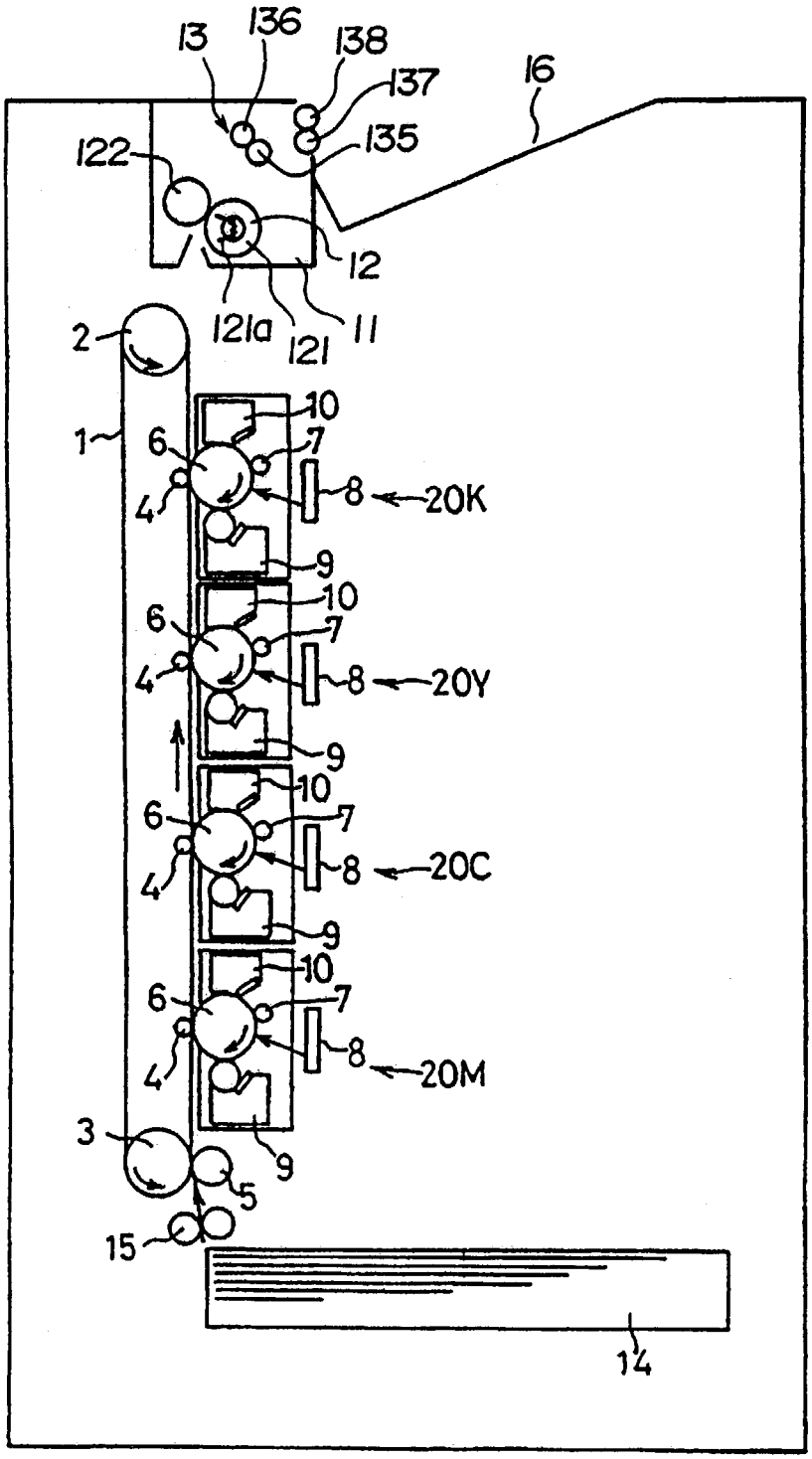
FIG. 1 is a diagram showing an image forming apparatus to which this invention applies.

FIG. 1 is a schematic diagram showing an embodiment of an image forming apparatus to which this invention applies. This image forming apparatus includes a transfer material conveyance belt (ETB) 1 tensioned by a drive roller 2 and a tension roller 3, which are disposed vertically. Process stations 20M, 20C, 20Y, and 20K for magenta (M), cyan (C), yellow (Y), and black (K) are arranged on a peripheral surface of the conveyance belt 1 so as to be aligned in a vertical line. In each process station, a photosensitive drum 6 (photosensitive body in a drum shape) serving as an image carrier is in contact with a transfer roller 4 via the conveyance belt 1.

An attracting roller 5 is disposed at a position on an upstream side of the process station 20M at a lower end of the conveyance belt 1. The attracting roller 5 is in contact with the tension roller 3 also serving as an attracting facing roller via the conveyance belt 1. A fixing unit 11 is disposed above the conveyance belt 1.

The transfer material is fed from a feeding cassette 14, and the transfer material is introduced by a pickup roller 15 to the conveyance belt 1 and is attracted electrostatically to the conveyance belt 1 by application of bias voltage when passing through a nipping section constituted of an attracting roller 5 and a tension roller 3. The transfer material attracted to the conveyance belt 1 is conveyed in a vertical direction as a vertically upward direction by the conveyance belt 1.

To form images, a surface of a photosensitive drum 6 in each process stations 20M to 20K is charged uniformly with an electric charger 7, and latent images are formed on the surface with an exposing optical system 8. These latent images are developed by a developing unit 9 to be visualized as toner images. The toner images in respective colors on the respective photosensitive drums 6 are then transferred to a transfer material on a conveyance belt 1 with a transfer roller 4 at a transfer section facing to the photosensitive drum 6, thereby forming a multicolor image by overlaying the four color toner images on the transfer material. Toners remaining after transfers of toner images on the photosensitive drums 6 are wiped out by a cleaner 10 to render the surfaces of the photosensitive drums 6 clean.

With a reverse development method, a negative OPC photosensitive body is used for the photosensitive drum, and since the exposed portions are developed with a negative toner, a positive transfer bias voltage is fed to the transfer roller 4 from a bias power supply not shown. The transfer roller 4 is made of a low resistance roller.

In actual process for image formation, conveyance of the transfer material and image formation and transfer at the respective process stations are done at timings in which the toner images in respective colors to be transferred onto the transfer material positionally match with each other in consideration of the moving speed of the conveyance belt 1 and the distance between the transfer positions of the respective process stations, thereby forming color images by transferring four-color toner images on the transfer material in an overlaying manner while the transfer material is passed one time through the process stations 20M, 20C, 20Y, and 20K for magenta, cyan, yellow, and black.

The transfer material on which the color image is formed is separated by a curvature at an upper end, or namely at a downstream end, of the conveyance belt 1, and is further conveyed to the fixing unit 11 at which fixing is made.

The fixing unit 11 includes a fixing section 12 disposed over a conveyance route for the transfer material made of the conveyance belt 1, and a delivery section 13 disposed over there.

The fixing section 12 includes a heating roller 121 equipped with a halogen heater 121*a* at a center of the interior thereof, and a pressing roller 122 in contact with the heating roller 121. In this embodiment, the heating roller 121 and the pressing roller 122 have a fixing nipping section extending in a vertical direction. The fixing unit 11 melts the toner images and fixes the toner images onto the transfer material with application of heat and pressure while the transfer material to which the toner images are transferred is conveyed in being nipped with the heating roller 121 and the pressing roller 122.

To melt and fix the toner on the transfer material desirably, it is necessary to ensure the nipping contact between the heating roller 121 and the pressing roller 122, and therefore, the respective rollers are structured as formed with an elastic layer made of a silicone rubber at a peripheral surface of a core metal made of, e.g., aluminum. A resin having good stripping property such as PFA, PTFE is coated on a topmost layer of the rollers to prevent toners and paper powders from adhering to the surfaces of the rollers 121, 122.

The delivery section 13 is constituted of a pair of delivery rollers 135, 136, which rotate around rotary shafts 135*s*, 136*s*, respectively, as centers, and is arranged above an outlet of the fixing section 12 so as to receive the sheets conveyed from the fixing section 12. The transfer material to which the toner images are fixed upon passage through the fixing section 12 is introduced to the exterior of the fixing unit 11 by a second delivery roller pair 137, 138, and is stacked on a delivery tray 16 finally.

In this embodiment, where an OHP sheet as a transfer material is used, the conveyance speed during fixing is reduced at a speed approximately one fourth of the speed for ordinary paper such as plain paper or the like to obtain good transparency upon evenly melting the toner images on the OHP sheet in application of adequate heat from the heating roller 121. Therefore, the transfer material passes through the delivery roller pair 135, 136 while the toner on the OHP sheet is melted by heat and softened, and in a prior art, a problem was raised in which a roller mark is likely attached to the toner image at that time.

Figure 2:
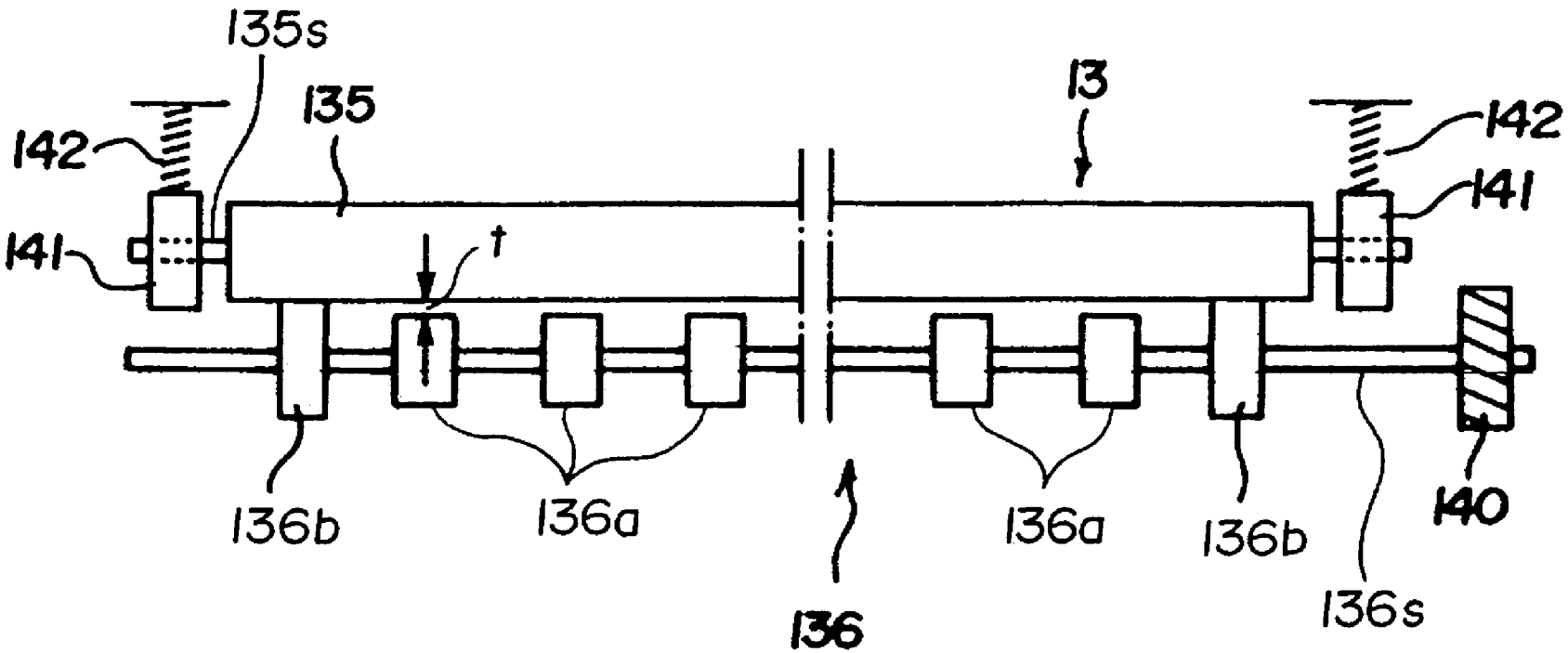
FIG. 2 is an illustration showing a delivery section according to the first embodiment of the invention.

To prevent such a problem from occurring in this embodiment, as shown in FIG. 2, a roller (hereinafter referred to as "image surface roller") 135 on a side that the toner image of the OHP sheet passes, between the delivery roller pair 135, 136, is structured of a roller at least having a width (length) equal to or larger than the image area on the OHP sheet in a direction perpendicular to the sheet conveyance direction. A roller 136 facing to the image surface roller 135 (hereinafter referred to as "facing roller") is structured by attaching a group of plural short rollers 136*a* and drive rollers 136 to a rotary shaft 136*s*. The drive roller 136*b* has a larger diameter in comparison with the short rollers 136*a*, and the drive roller 136*b* keeps a space of a prescribed gap t with respect to the image surface roller 135 (gap t=0.4 mm in this embodiment) upon contact to the surface of the image surface roller 135. More specifically, the facing roller 136 creates a gap t of a prescribed width between the image surface roller 135 and the facing roller 136 from the difference between diameters of the short rollers 136*a* and the drive roller 136*b* by means of the drive roller 136*b* formed outwardly of the sheet passage area, and the facing roller 136 rotates the image surface roller 135 as driven in contact with the drive roller 136*b* of the facing roller 136 according to the rotation of the facing roller 136 with a gear 140 secured to an end of the rotary shaft 136*s* of the facing roller 136. The gap t is necessarily larger than the thickness of about 0.1 mm of the OHP sheet as a lower limit. The gap is preferably 2 mm or below as an upper limit because the conveyance ability of the sheet as described below may be lowered if the gap t is too large. The image surface roller 135 is rotatably supported to a bearing 141 at the each end, and is in contact with the drive roller 136*b* in a state that the bearing 141 is urged toward the facing roller 126 by a spring 142.

In this embodiment, the respective short rollers 136*a* of the facing roller 136 are structured of a silicone rubber having a diameter of 11 mm; the drive roller 136*b* is structured of a silicone rubber having a diameter of 11.8 mm; the image surface roller 135 is structured of PFA having a diameter of 9 mm. From those structures, the toner is rendered not to adhere to the image surface roller 135. It is to be noted that the size and material of those structural parts are merely examples, as not limiting the scope of this invention.

Thus, the image surface roller 135 contacting to the toner image surface side immediately after fixing is not provided dividedly as in the prior art in the direction perpendicular to the sheet conveyance direction but widened at least equal to or more than the image width on the sheet to prevent any roller mark from occurring at the toner image on the OHP sheet. Furthermore, the facing roller 136 is kept in non-contact with the image surface roller 135, thereby preventing the OHP sheet after fixing from being quickly cooled by the delivery roller pair 135, 136, and thereby preventing any curling from occurring.

Figure 3:
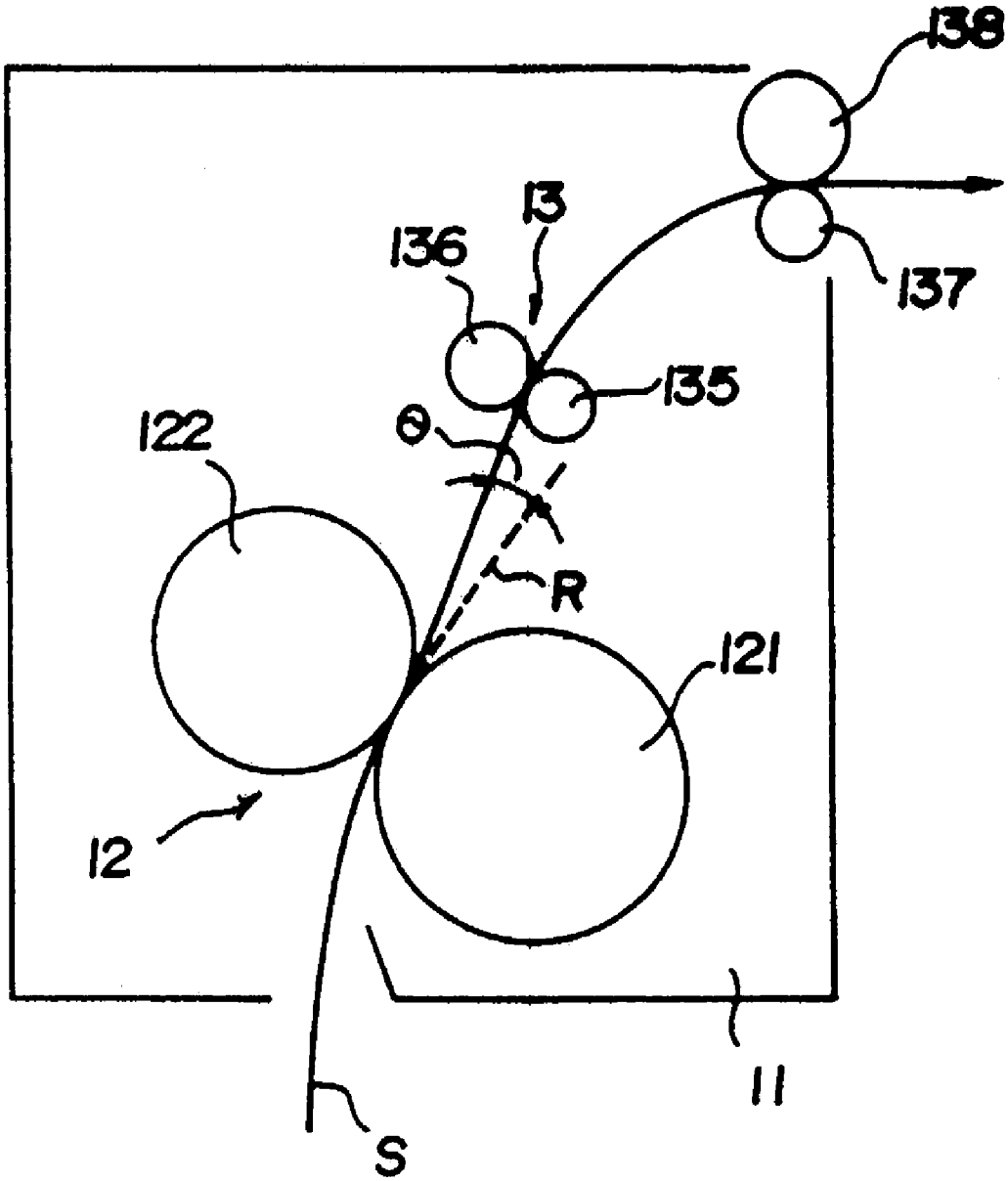
FIG. 3 is an illustration showing a delivery section according to the first embodiment of the invention.

As shown in FIG. 3, the facing portion (nipping section) of the delivery roller pair 135, 136 is located at an offset position toward the image surface roller 135 by a prescribed angle θ toward the pressing roller 122 from tangential line R at the fixing nipping section between the heating roller 121 and the pressing roller 122. That is, the trace of the sheet in a tensioned state conveyed as nipped by both of the fixing nipping section and the nipping section of the delivery roller pair is angled of a prescribed angle θ with respect to the tangential line R at the fixing nipping section. The sheet S is able to contact with both of the rollers 135, 136 in aid of the rigidity of the OHP sheet S, even where the delivery roller pair 135, 136 is not in contact with each other, so that the conveyance force is given. Moreover, with such an offset layout of the delivery roller pair 135, 136 with respect to the fixing roller pair 121, 122, the OHP sheet S, after passed through the fixing nipping section, is promptly separated from the heating roller 121, thereby preventing the OHP sheet from being subject to loss of transparency or the like due to hot offset. The hot offset is generally a phenomenon in which toner adheres to the surface of the heating roller when the toner is overly heated with the heating roller 121 or the like, and in which, at that time, loss of transparency in the toner image on the OHP sheet S and the projection image occurs due to diffused reflection from the roughed surface of the toner image fixed to the OHP sheet S. This overly heating of the heating roller 121 can happen other than when the temperature is too high, e.g., when the heating time becomes too long where the OHP sheet S is pulled closely to the heating roller 121 as in a tendency of being wound at the separation time after fixing. To the contrary, quick separation of the OHP sheet S after fixing as in this embodiment can prevent the hot offset from occurring. In this embodiment, a good result was obtained where the prescribed angle θ was set to about 10 degrees for the offset layout.

Second Embodiment

Hereinafter, the second embodiment of the invention is described. Although in the first embodiment the roller made of PFA is used for the image surface roller 135, this embodiment has an object to not easily create curling of the OHP sheet by further improvement of heat resistance of the image surface roller 135.

Figure 4:
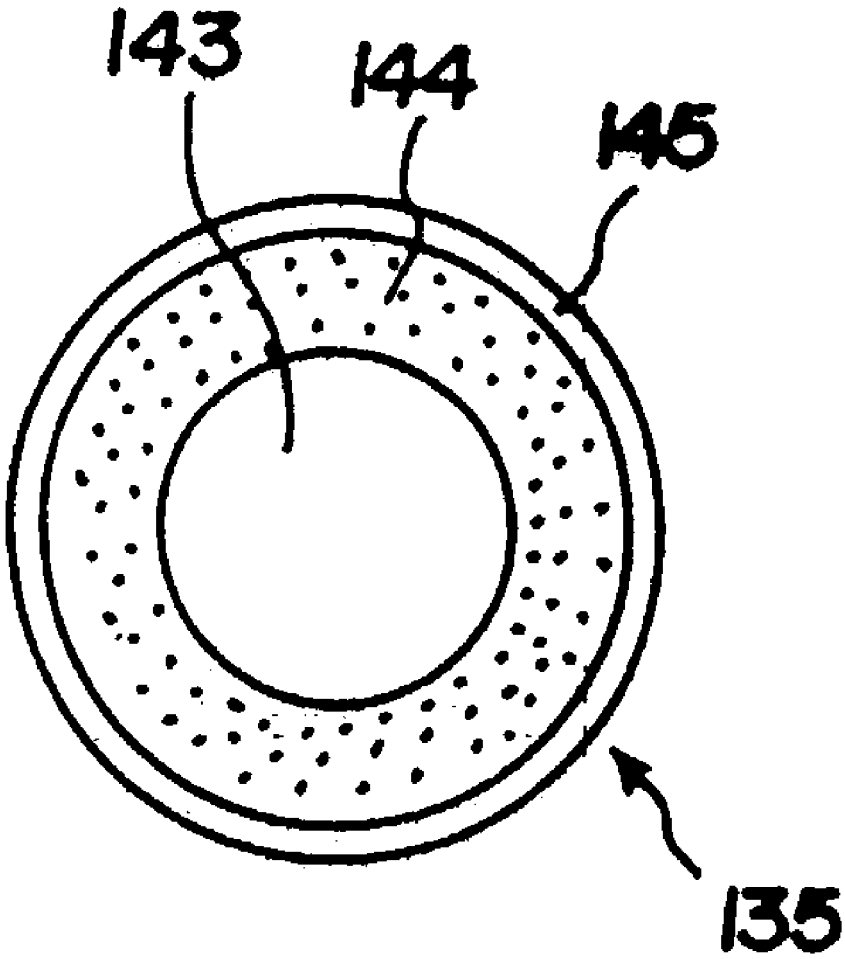
FIG. 4 is an illustration showing a delivery section according to the second embodiment of the invention.
Figure 5:
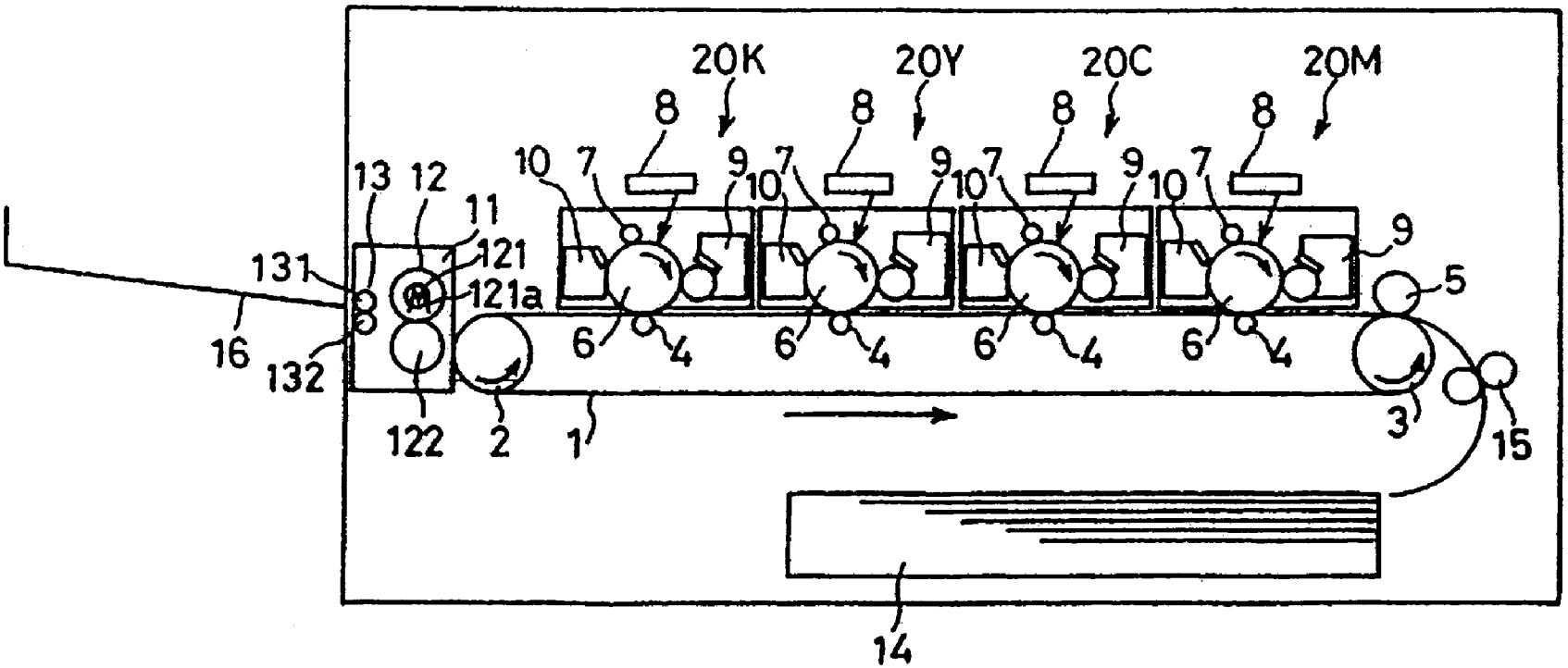
FIG.5 (Prior Art)
FIG. 5 is a diagram showing a prior art.
Figure 6:
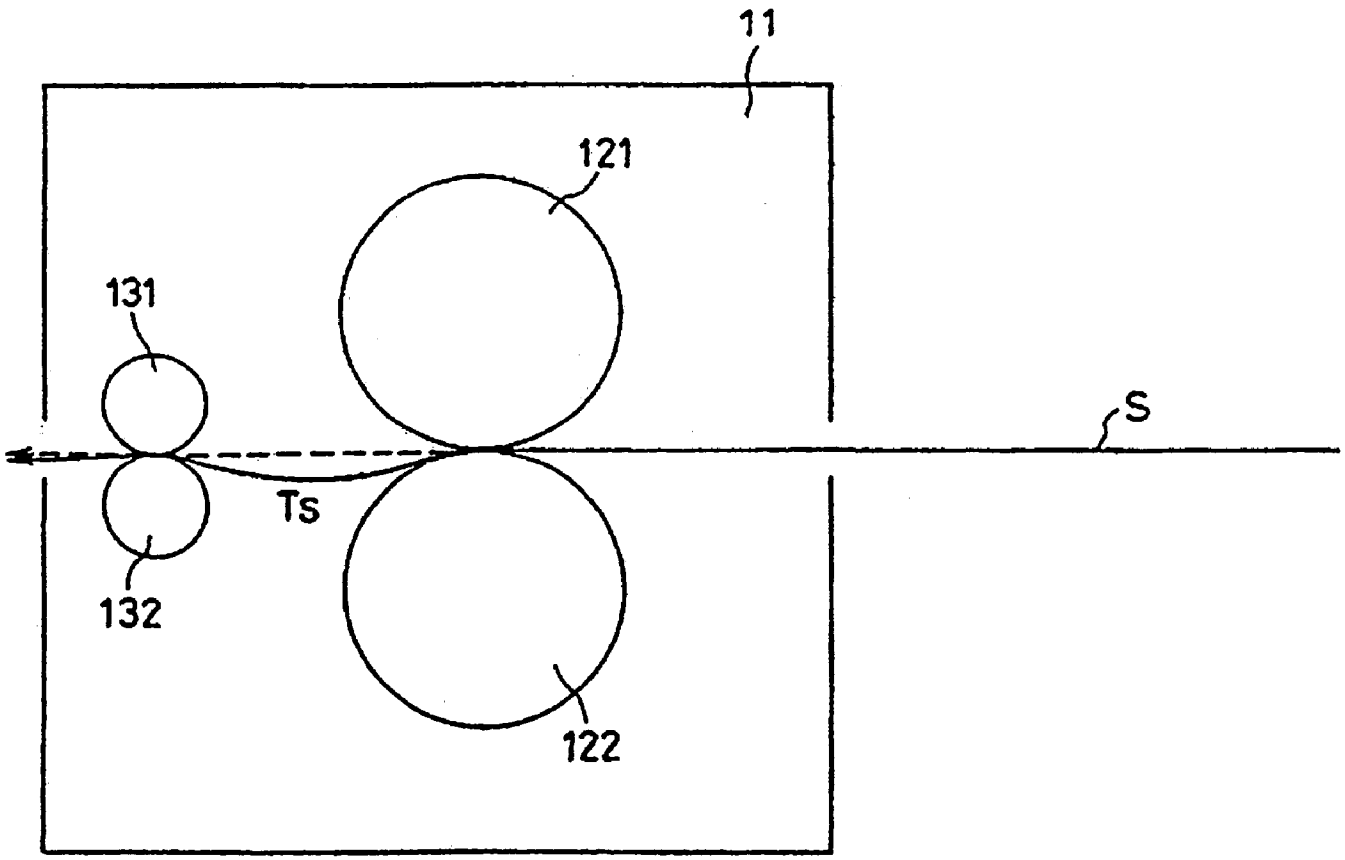
FIG.6 (Prior Art)
FIG. 6 is a diagram showing a prior art.
Figure 7:
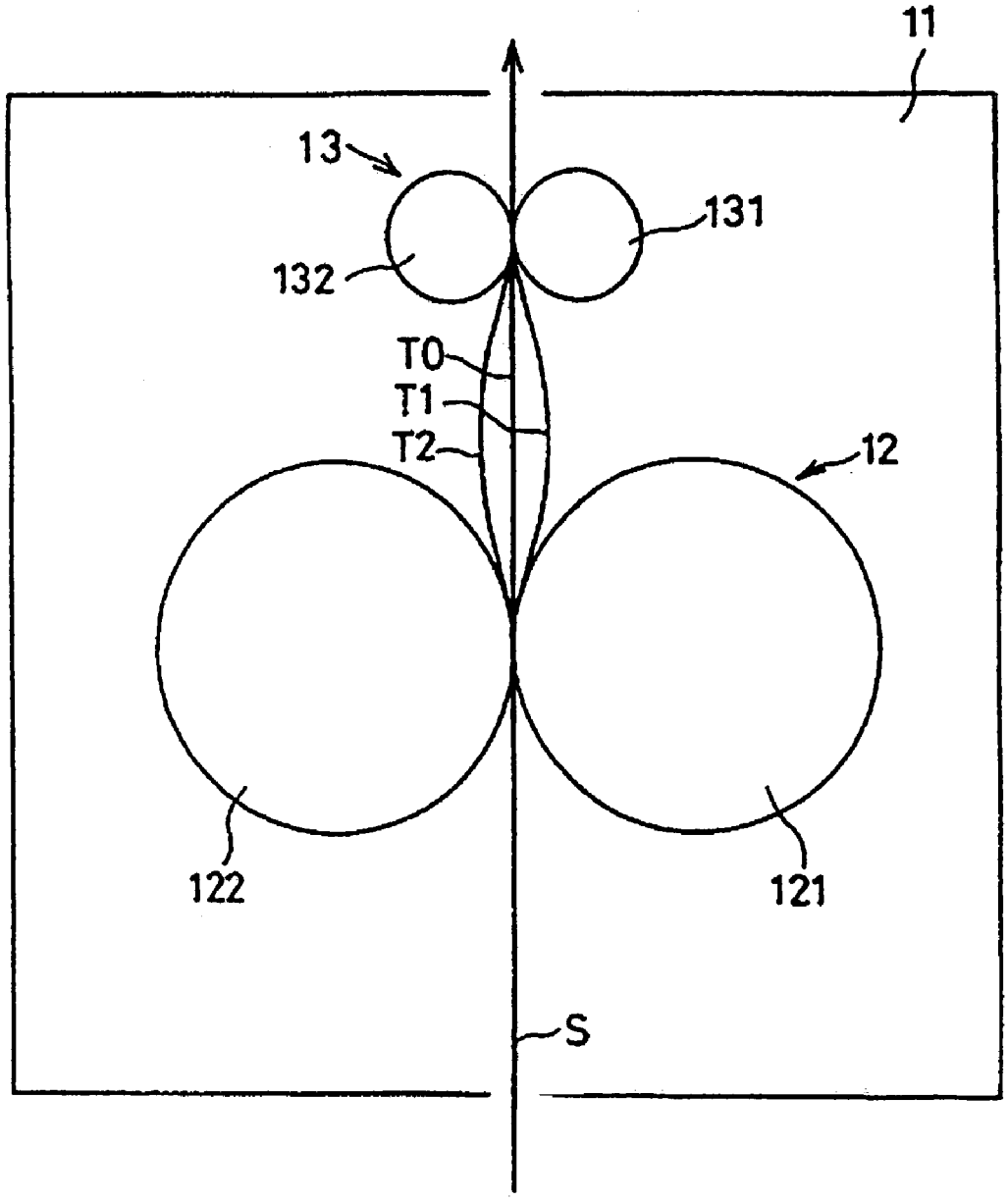
FIG.7 (Prior Art)
FIG. 7 is a diagram showing a prior art.
Figure 8:
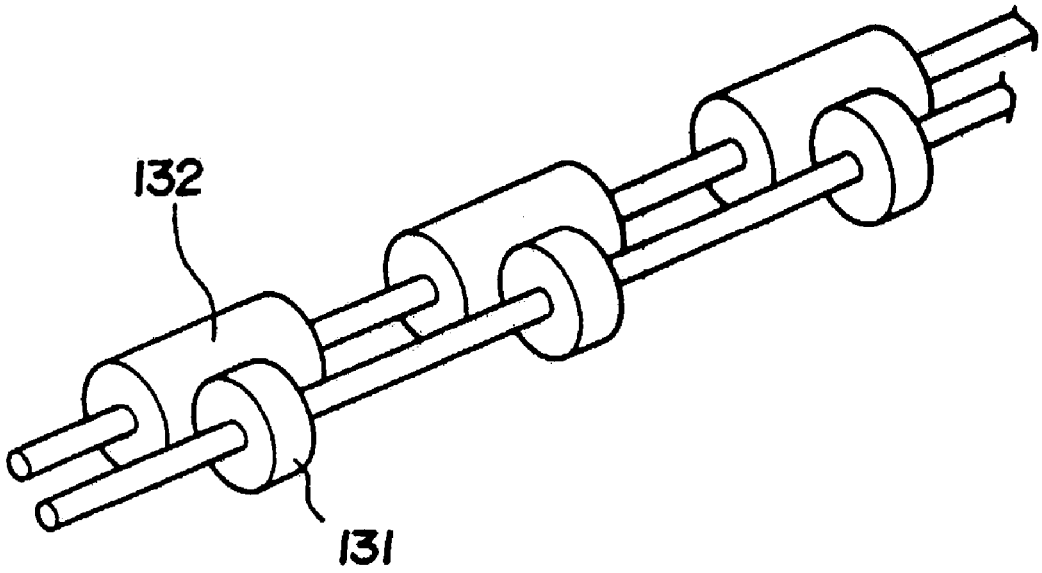
FIG.8 (Prior Art)
FIG. 8 is a diagram showing a prior art.
Figure 9:
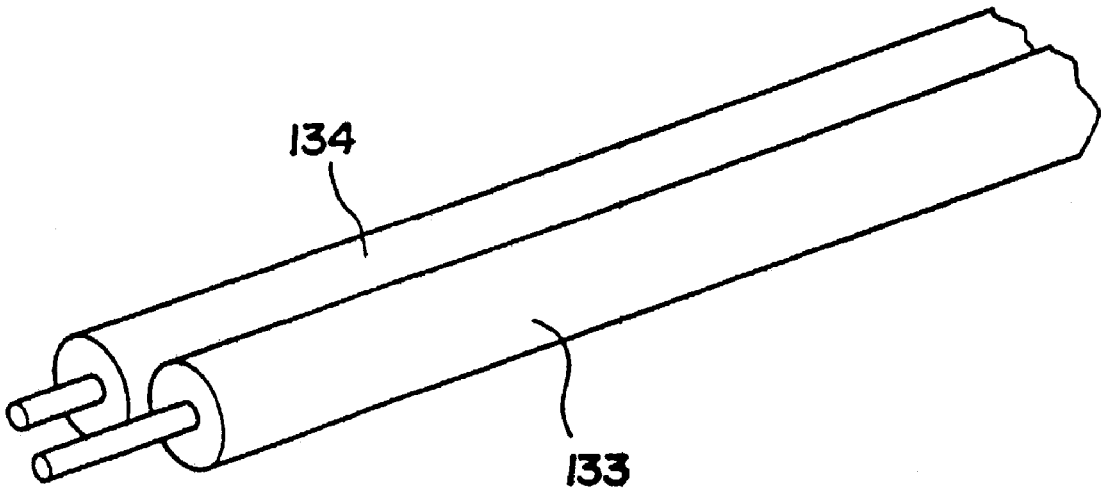
FIG.9 (Prior Art)
FIG. 9 is a diagram showing a prior art.

More specifically, the image surface roller 135 is structured as shown in FIG. 4. As shown in FIG. 4, the image surface roller 135 is formed with a foamed silicone rubber layer 144 of thickness 1.5 mm on a core metal 143 and with a PFA tube 145 of thickness 30 microns thereon. The diameter of the drive roller 136*b* only is designed to be 12.0 mm in consideration of recess about 0.1 mm formed at the foamed silicone rubber layer 144 of the image surface roller 135 when the image surface roller 135 and the drive roller 136*b* are in contact with each other as shown in FIG. 2. Because other structures, sizes, and shapes are substantially the same as those in the first embodiment, a duplicated description is omitted.

With this structure, the PFA tube 145 prevents the toner from adhering to the delivery roller 135 while the foamed silicone rubber layer 144 prevents the heat of the OHP sheet from being removed by the image surface roller 135, so that occurrence of curling of the OHP sheet is greatly improved.

Other Embodiments

Although in the embodiments above, the heating roller having the halogen heater inside is exemplified as a heating member, this invention is not limited to this, and for example, substantially the same advantages can be obtained, as a matter of course, with a fixing unit of on-demand type in which a heating member of a film type is heated directly by the heater, or with a fixing unit of a type (1H type) in which a sleeve of a thin film type or cylindrical type is heated with web currents induced by electromagnetic induction.

Although an OHP sheet is exemplified as a transfer material, this invention is not limited to this, and for example, such as a gloss paper or gloss film for gaining highly glossed surface has an advantage to prevent any roller mark from occurring as differences of gloss or curling from occurring.

In the above embodiment, exemplified is that the gap t is formed between the rollers 135, 136 by providing the drive roller 136*b* having the larger diameter than the short roller 136*a* and having in contact with the image surface roller 135 on an outer side of the sheet passage area of the facing roller 136, and that both of the rollers 135, 136 are driven to rotate, but the invention is not limited to those. For example, a possible structure is that the gap t is formed between the rollers 135, 136 by providing the drive roller having the larger diameter than the roller 135 and having in contact with the facing roller 136 on an outer side of the sheet passage area of the image surface roller 135, and that both of the rollers 135, 136 are driven to rotate, but the invention is not limited to those.

Although the facing roller 136 is constituted of the plural short rollers 136*a* attached to the rotary shaft 136*s* and the drive rollers arranged on each side, a single long roller may be placed in lieu of the plural short rollers 136*a*, and the diameter of each end of this roller may be designed to be larger to be served as a drive roller.

In the above embodiments, the delivery section 13 as a transfer material conveying apparatus to which this invention applies (the delivery roller pair 135, 136) is exemplified as having a structure in a united body with the fixing unit 11 including the fixing section 12, but this invention is not limited to this, and for example, the delivery section can be structure as separated from the fixing unit 11.

In the above embodiments, the four process stations are used, but the number of the stations is not limited, and the number can be set as needed. It is to be noted that the process station including the photosensitive drum can be structured as detachable from the apparatus body, or as each structural element for the process station can be detachable from each other.

Although in the above embodiments the printers are exemplified as image forming apparatuses, this invention is not limited to those. For example, other image forming apparatuses such as photocopiers, facsimile machines, and an image forming apparatus in which an intermediate transfer body is used to which toner images in respective colors are transferred step by step in an overlaying manner and in which the toner images on the intermediate body is transferred at once to the transfer material, and substantially the same advantages can be obtained in application of the invention to such image forming apparatuses.

What is claimed is:

1. A transfer material conveying apparatus for conveying a transfer material to which an image is fixed, the apparatus comprising:

an image surface roller located on an imaging surface side of the transfer material and disposed on a downstream side in a conveyance direction of the transfer material of a heating member and a pressing member for fixing an image to the transfer material;

a facing roller located in a facing relationship to the image surface roller and disposed on the downstream side of the heating member and a pressing member; and a discharge roller pair for discharging the transfer material disposed on a downstream side of the image surface roller and the facing roller, wherein the facing roller is spaced from the image surface roller at a prescribed distance across a transfer material passage area, and wherein the image surface roller and the facing roller convey the transfer material in an inclining direction relative to a vertical direction.

2. The transfer material conveying apparatus according to claim 1, wherein a facing section between the image surface roller and the facing roller is located at an offset position by a prescribed angle θ toward the pressing member from a tangential line at a contact section between the heating member and the pressing member, which are in contact with each other.

3. The transfer material conveying apparatus according to claim 1, wherein the image surface roller and the facing roller are in contact with each other at a non-passage area of the transfer material such that one roller drives the other roller.

4. The transfer material conveying apparatus according to claim 1, wherein the transfer material is an OHP sheet.

5. The transfer material conveying apparatus according to claim 1, wherein a length of the image surface roller is equal to or longer than a width of an image area on the transfer material in a direction perpendicular to the conveyance direction.

6. The transfer material conveying apparatus according to claim 1, wherein the image surface roller and the facing roller are disposed upwardly from the heating member and the pressing member.

7. An image forming apparatus in which a toner image is formed by developing a latent image formed on an image carrier with toner, wherein the toner image is transferred to the transfer material via or not via an intermediate transfer body, and in which the toner image is then fixed onto the transfer material by application of heat and pressure with a fixing means, the image forming apparatus comprising:

the fixing means including a heating member and a pressing member, which are in contact with each other; and the transfer material conveying apparatus as set forth in any one of claims 1 to 7, disposed on the downstream side with respect to the heating member and the pressing member.

8. The image forming apparatus comprising:

a fixing unit including a heating roller for heating a transfer material on which an image is formed, and a pressing roller for pressing the transfer material;

a delivery roller pair including an image surface roller located on an image surface side of the transfer material, and a facing roller in a facing relationship to the image surface roller, disposed on a downstream side of the fixing unit in a conveyance direction of the transfer material; and a discharge roller pair for discharging the transfer material disposed on a downstream side of the delivery roller pair, wherein the facing roller is spaced from the image surface roller at a prescribed distance across a transfer material passage area, and wherein the delivery roller pair convey transfer material in an inclining direction relative to a vertical direction.

9. The image forming apparatus according to claim 8, wherein a facing section between the image surface roller and the facing roller is located at an offset position by a prescribed angle θ toward the pressing member from a tangential line at a contact section between the heating member and the pressing member, which are in contact with each other.

10. The image forming apparatus according to claim 8, wherein the image surface roller and the facing roller are in contact with each other at a non-passage area of the transfer material such that one roller drives the other roller.

11. The image forming apparatus according to claim 8, wherein the image surface roller and the facing roller are disposed upwardly from the heating roller and the pressing roller.

12. The image forming apparatus according to any one of claims 8 to 11, wherein a length of the roller pair is equal to or longer than an image area on the transfer material in a direction perpendicular to the conveyance direction.

13. An image forming apparatus comprising:

a photosensitive drum for carrying a toner image;

a transfer member for transferring the toner image carried on the photosensitive drum to a sheet;

a heating member and a pressing member for fixing the toner image to the sheet in conveying the sheet as nipped;

a conveyance roller pair for conveying the sheet disposed on a downstream side of the heating member and the pressing member, one roller of the roller pair is spaced from the other roller of the roller pair at a prescribed distance across a sheet passage area; and a discharge roller for discharging the sheet disposed on a downstream side of the conveyance roller pair, wherein the roller pair convey the transfer material in an inclining direction relative to a vertical direction.

14. The image forming apparatus according to claim 13, wherein a roller located on an opposite side to an image surface side of the sheet, of the roller pair, has a peripheral surface in discontinuous contact with the sheet in a longitudinal direction.

15. The image forming apparatus according to claim 13 or 14, wherein the roller pair is disposed upwardly from the heating member and the pressing member.

16. A transfer material conveying apparatus for conveying a transfer material to which an image is fixed, the apparatus comprising:

an image surface roller located on an imaging surface side of the transfer material and disposed on a downstream side in a conveyance direction of the transfer material of a heating member and a pressing member for fixing an image to the transfer material; and a facing roller located in a facing relationship to the image surface roller and disposed on the downstream side of the heating member and a pressing member, wherein the facing roller is spaced from the image surface roller at a prescribed distance across a transfer material passage area, and wherein the image surface roller includes a foamed elastic layer on a core metal, and fluorocarbon outer stripping layer.

* * * * *

UNITED STATES PATENT AND TRADEMARK OFFICE

CERTIFICATE OF CORRECTION

PATENT NO. : 7,020,433 B2
APPLICATION NO. : 10/354024
DATED : March 28, 2006
INVENTOR(S) : Akihiko Takeuchi et al.

It is certified that error appears in the above-identified patent and that said Letters Patent is hereby corrected as shown below:

ON THE COVER PAGE:

UNDER REFERENCES CITED, ITEM (56):

"63277171" should read --63-277171--;
"01214542" should read --1-214542--;
"01271350" should read --1-271350--;
"04066466" should read --4-66466--;
"04291277" should read --4-291277--;
"09188450" should read --9-188450--; and
"2001226015" should read --2001-226015--.

IN THE ABSTRACT, ITEM (57):

Line 8, "in facing to" should read --facing--.

COLUMN 1:

Line 37, "that" should read --that has--.

COLUMN 2:

Line 19, "that" should read --such that--;
Line 22, "to the" should be deleted.
Line 35, "is" should be deleted.

COLUMN 4:

Line 16, "far" should read --long--.

COLUMN 6:

Line 58, "is" should read --are--; and
Line 61, "after" should read --after having--.

COLUMN 7

Line 5, "overly" should read --excessive--; and
Line 67, "in" should be deleted.

UNITED STATES PATENT AND TRADEMARK OFFICE

CERTIFICATE OF CORRECTION

PATENT NO. : 7,020,433 B2
APPLICATION NO. : 10/354024
DATED : March 28, 2006
INVENTOR(S) : Akihiko Takeuchi et al.

It is certified that error appears in the above-identified patent and that said Letters Patent is hereby corrected as shown below:

COLUMN 8:

Line 17, “structure” should read --structured--.

COLUMN 9:

Line 26, “claims 1 to 7,” should read --claims 1 to 6,--.

COLUMN 10:

Line 20, “is” should read --being--.

Signed and Sealed this

Fourteenth Day of November, 2006

JON W. DUDAS
*Director of the United States Patent and Trademark Office*